United States Patent [19]

Furuya et al.

[11] 4,101,024

[45] Jul. 18, 1978

[54] INDIVIDUAL, DISPOSABLE HOLDERS FOR CIGARETTES AND DISPENSERS THEREOF

[76] Inventors: Seiji Furuya, 151 N. Alvarado Ave., Ojai, Calif. 93023; Roger H. Smartt, 77 Hackberry Dr., Ventura, Calif. 93001

[21] Appl. No.: 708,582

[22] Filed: Jul. 26, 1976

[51] Int. Cl.[2] ..... A24F 13/08; A24F 13/22

[52] U.S. Cl. ..... 206/102; 131/257; 206/103

[58] Field of Search ..... 131/175, 186–187, 131/190, 240 R, 257–260; 206/38, 86, 90, 96, 102–104, 236–237, 242, 524.3, 526

[56] References Cited

U.S. PATENT DOCUMENTS

| | | | |
|---|---|---|---|
| 364,504 | 6/1887 | Fouts | 131/257 |
| 368,466 | 8/1887 | Fouts | 131/257 |
| 889,207 | 6/1908 | Crane | 131/257 X |
| 1,634,712 | 7/1927 | Friedman | 206/103 |
| 2,011,399 | 8/1935 | Driscoll | 206/237 |
| 2,042,584 | 6/1936 | Bustamante | 206/104 X |
| 2,212,773 | 8/1940 | Gray | 206/96 |
| 2,268,379 | 12/1941 | Bird et al. | 206/103 |
| 2,320,561 | 6/1943 | Brady et al. | 131/257 |
| 2,547,779 | 4/1951 | Renyck | 206/104 X |
| 2,965,107 | 12/1960 | Lehv | 131/257 |

FOREIGN PATENT DOCUMENTS

| | | | |
|---|---|---|---|
| 22,321 of | 1892 | United Kingdom | 131/257 |

*Primary Examiner*—Steven E. Lipman
*Attorney, Agent, or Firm*—Casimir A. Miketta

[57] ABSTRACT

Relates to individual, inexpensive, disposable holders particularly adapted for use in smoking short stubs of paper-wrapped cigarettes of the unfiltered type (without a cardboard mouthpiece) and containing shredded, dried leaves of herbs and plants. Also relates to small, pocket-size dispensers in which a plurality of such holders are carried for individual removal as needed. Matches and rolling papers may also be carried in such dispensers.

1 Claim, 13 Drawing Figures

INDIVIDUAL, DISPOSABLE HOLDERS FOR CIGARETTES AND DISPENSERS THEREOF

Since the 17th century, after Sir Walter Raleigh brought tobacco (the dried leaf of a variety in the family of the deadly nightshade) to England, the smoking of herbs and various weeds has increased enormously and is socially accepted without regard to pronouncements by certain groups. Incompletely smoked cigars and short cigarette butts which were discarded by our grandparents were often smoked by others by passing a common pin through the butt or stub and using such a pin as a holder (according to O. Henry, Damon Runyon and H. L. Mencken, among other notables). The younger generations of modern times have found the smoking of other weeds and herbs, such as grass and varitions of the species Cannabis Sativa to give them pleasure, and the butts, stubs and roaches of their hand-rolled cigarettes, sticks or joints are deemed sufficiently worthy to be treasured and smoked.

However, the pin is a very unsatisfactory holder, since it perforates and ventilates the paper wrapper and does not hold the stub firmly in a readily manipulatable position. Moreover, even a lowly pin may not be easily available for use.

One of the objects of this invention, therefore, is to disclose and provide an inexpensive, individual, disposable holder particularly adapted for smoking a short stub or roach of a cigarette not provided with a stiff mouthpiece and usually having an irregularly shaped, virtually conical or cylindrical end of uncertain diameter, said holder embracing such end firmly but without puncturing the wrapper, with an easily held and manipulatable handle portion extending virtually at a right angle to the axis of the stub.

Another object is to disclose and provide inexpensive pocket-size dispensers, preferably light in weight and virtually non-metallic, containing a plurality or array of the aforesaid individual and disposable holders, arranged to be easily and individually removed from said dispenser, without disturbing other holders in such array. In more sophisticated forms of the invention, each dispenser may also include an array of matches, a suitable match-striking surface and even a plurality of rolling papers in readily accessible condition.

These and other objects and advantages of the invention will become apparent from the following description of a number of illustrative examples of forms of this invention, it being understood that all changes in materials and proportions which come within the scope of the claims are embraced thereby.

In order to facilitate understanding, reference will be made to the appended drawings, in which.

Figure 1:
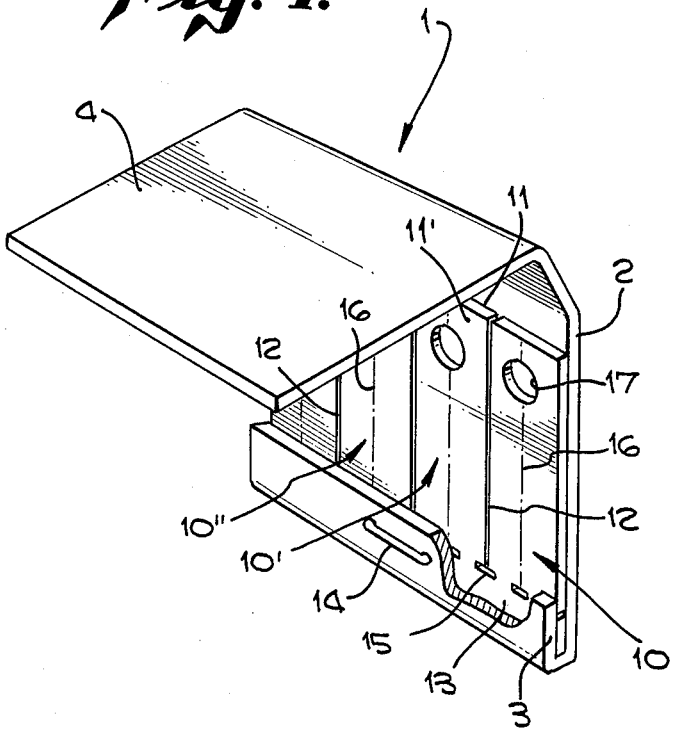
FIG. 1 is an isometric representation of one simple form of dispenser carrying an array of one form of individual holder in partly open condition, a portion of the housing being broken away.
Figure 2:
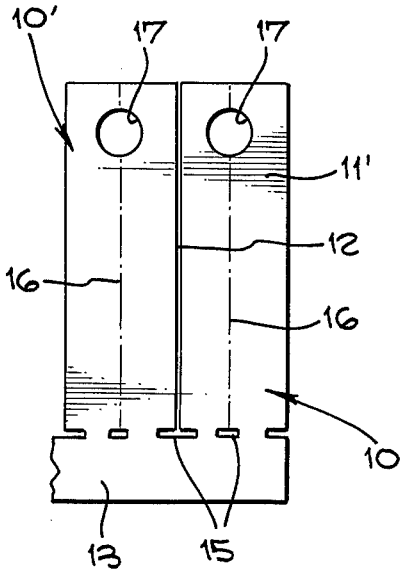
FIG. 2 is a plan view of a part of an array of holders of the type used in the dispenser of FIG. 1.
Figure 3:
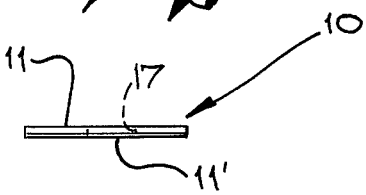
FIg. 3 is an enlarged end view of one of the holders of FIGS. 1 and 2.
Figure 5A:
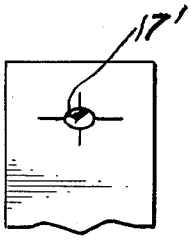
Figure 5B:
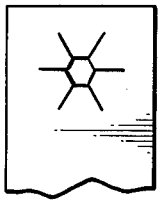
Figure 5C:
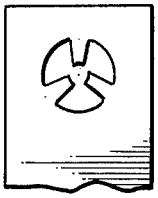
Figure 7:
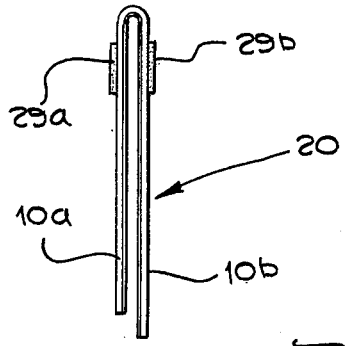
Figure 6:
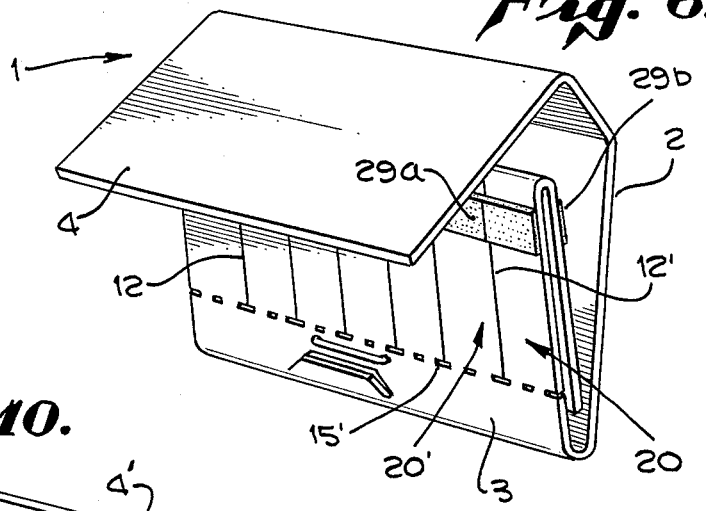
Figure 10:
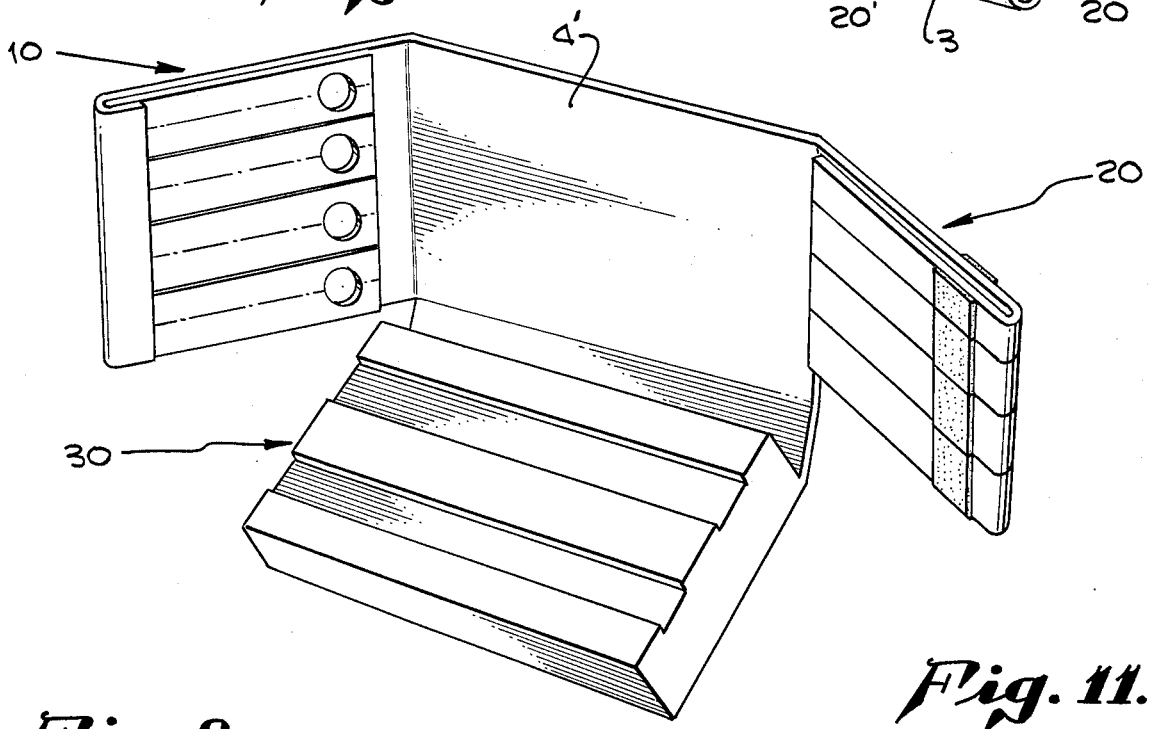
Figure 8:
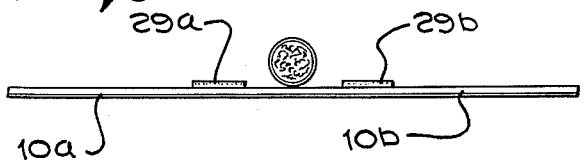
Figure 11:
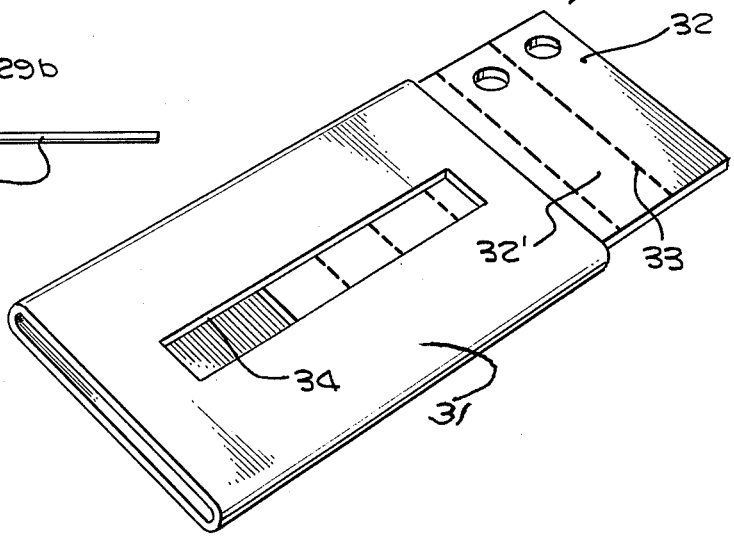
Figure 9:
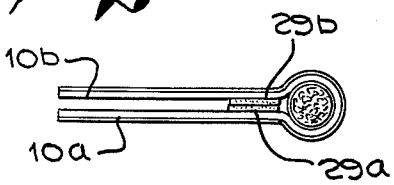

FIGS. 5*a*, 5*b* and 5*c* are plan views of upper end portions of holders of the type shown in FIGS. 1, 2 and 3, illustrating some alternative forms of stub-grasping apertures.

FIG. 1 illustrates a pocket-size dispenser comprising a housing generally indicated at 1, usually made of a fibrous composition which may contain a filler such as clay, and a suitable sizing material, resin or plastic to give it sufficient strength, foldability and durability. Many grades of utilizable cardboard are available and these may even be laminated with metallic foil to improve performance and enhance appearance. The housing 1 may include a back 2, the lower end portion being bent inwardly to form a bottom flap 3, and an integral front cover 4, the lower edge of which may engage the flap 3 (or a tab formed in such flap) to releasably hold the cover over the contents of the housing.

Figure 4:
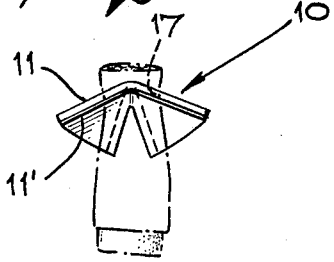
FIG. 4 is an enlarged top end view of the holder grasping a butt or roach, shown in dotted lines, in position for smoking.

The dispenser of FIG. 1 is shown as containing an array of elongated holders 10, 10', 10'' and the like, which may be formed from a single strip or sheet of body material 11, which is also preferably virtually non-metallic, moisture-resistant and somewhat resilient. As shown in FIGS. 2, 3 and 4, the body material may be slit as at 12 and 12' to form the individual holders 10, 10' and the like. It may be desirable to provide such body material with a surface laminate of metal foil or non-flammable polymer, such as a polyamide or fluoro carbon, (indicated at 11') to increase fire resistance. It is to be noted that the slits 12 define the longitudinal length of the individual holders 10, 10', 10'', but leave the array attached to a connecting, transversely extending, integral and unslit bottom tab portion 13 which may be received within the inturned bottom flap 3 of the housing and suitably attached thereto by an adhesive or a staple 14. Each of the individual holders 10, 10', etc., is provided with a transverse line of perforations 15 to facilitate separation of the holders individually from the tab.

The upper, free end portion of each holder is provided with means to receive, embrace and hold the end of a cigarette or stub while the lower and major portion of the body is adapted to act as a handle. To accomplish these functions, each individual holder, such as 10, is preferably longitudinally scored or indented along its axis as indicated by 16 and a port or aperture 17 intersecting such axis is formed in proximity to the upper end of the handle.

As best illustrated in FIG. 4, after a user has separated a holder from its housing, the handle portion can be readily folded along the axis 16 with finger pressure applied to the lower handle portion, thereby forming a trough with inclined sides, leading the small, generally cone-shaped end of a cigarette butt or roach into the aperture, and the edges of such aperture, assisted by the resiliency of the body material, embrace and hold the cigarette or butt with its axis virtually perpendicular to the axis of the holder, without perforating the thin paper wrapper of the cigarette. If desired, a small amount of adhesive may be carried by the lower surface portion of the handle on opposite sides of the axial score line 16, these adhesive areas cooperating when the handle portion is grasped to retain the thus formed handle element in at least a partly folded and more rigid condition and in a plane virtually parallel to the axis of the cigarette held thereby. When a metal laminate is used on the surface of the holder body, the excessive heat of the short butt is resisted. "Heat-resistant," as used herein, is understood to refer to temperatures normally developed when smoking cigarettes.

FIGS. 5*a*, 5*b* and 5*c* illustrate some of the many variations which can be used as the means for grasping the fragile, and usually non-circular, cigarette butt with minimal coverage and damage to the butt. As shown in the drawings, the apertures 17', 17", 17"' may be small and either circular, elliptical or polygonal in form, and in the inner edge may be provided with spaced, flexible fingers as in FIG. 5c, or slit so as to provide flexible fingers or dogs, as in FIGS. 5a and 5b, to hold the butt. The central aperture can be much smaller than the diameter of the butt and the use of a number of flexible fingers extending outwardly increases the surface area of the holder fingers resiliently pressed against the butt to hold it in position. This arrangement allows cigarettes of varying end shapes and sizes to be easily accommodated.

When a laminate is used for the body portions, the heat-resistant metallic or polymer foil or coating is preferably on that surface which will contact the butt. In a modification, a heavier gauge, heat-resistant foil alone may be used instead of a fibrous composition or laminate with good results, particularly if it is readily conformable or malleable.

A book of matches could be connected to and along one edge of the cover and holders along another.

It is to be understood that our invention is not limited to the several exemplary forms and arrangements described and illustrated herein, since the holders can be used in various housings or even without dispensers including holders may also contain arrays of matches. Various forms of closures may be used on the dispensers, appropriate to the quality and kind of materials employed and the economic demands and requirements to be met. All such changes coming within the scope of the appended claims are embraced thereby.

We claim:

1. As an article of manufacture, an array of a plurality of individually separable disposable holder elements particularly adapted for smoking a short stub of a cigarette not provided with a mouthpiece and usually have an irregularly shaped, virtually conical end, said array being formed from a body of planar sheet material provided with a plurality of transversely spaced, parallel, longitudinal slits separating individual holder elements extending from a transversely extending, unslit tab portion and a line of perforations adapted to facilitate separation of individual holder elements from said tab portion, each of said individual holder elements having means, at a zone removed from said tab portion, integral with said sheet material for receiving, holding and embracing the stub end of a cigarette with its axis virtually at right angles to the holder element, each holder element of said array being provided with a longitudinally extending medial score line to facilitate folding therealong, and each of the holding means comprising an aperture intersecting said medial score line adjacent the end of the holder element removed from the tab portion, said aperture being adapted to receive, grasp and hold an irregularly shaped end of a cigarette guided to said aperture by a trough formed by portions of the holder element on opposite, lateral sides of the medial score line partly folded toward each other along such line.

* * * * *